United States Patent [19]

Cohen

[11] 4,034,496

[45] July 12, 1977

[54] MODULAR PICTURE HOLDER

[75] Inventor: Bernard Cohen, Philadelphia, Pa.

[73] Assignee: C. F. Associates, Philadelphia, Pa.

[21] Appl. No.: 569,964

[22] Filed: Apr. 21, 1975

[51] Int. Cl.[2] ..... G09F 1/12

[52] U.S. Cl. ..... 40/152

[58] Field of Search ..... 40/152, 152.1, 156, 40/158; D6/234

[56] References Cited

U.S. PATENT DOCUMENTS

| | | | |
|---|---|---|---|
| 3,237,332 | 3/1966 | Retrey | 40/152 |
| 3,471,959 | 10/1969 | Seger | 40/152 |
| 3,654,719 | 4/1972 | Rochelt | 40/156 |
| 3,711,978 | 1/1973 | Conrad | 40/152 |
| D230,808 | 3/1974 | Edwards | D6/234 |

*Primary Examiner*—John F. Pitrelli
*Assistant Examiner*—Wenceslao J. Contreras
*Attorney, Agent, or Firm*—Weiser, Stapler & Spivak

[57] ABSTRACT

A modular picture holder includes a plurality of object containing compartments which are rearwardly joined and which are forwardly spaced each from the other. The compartments terminate rearwardly in planar alignment and forwardly in picture display compartments which are multiplanar. Each photograph containing compartment includes enclosing sidewalls, the said sidewalls inclining from the rear to the front of each compartment. The pictures or other objects to be displayed are retained in different planes, which combine with the tapered sidewalls of each compartment to impart a striking, three-dimensional, visual effect. The sidewalls of contiguous compartments define a inclined slot or canyon therebetween which enhance the three-dimensional visual effect. The picture holders are arranged in modular form and include rearwardly positioned clips suitable to interconnect any number of modules to form a larger photograph display pattern.

13 Claims, 14 Drawing Figures

FIG. 8
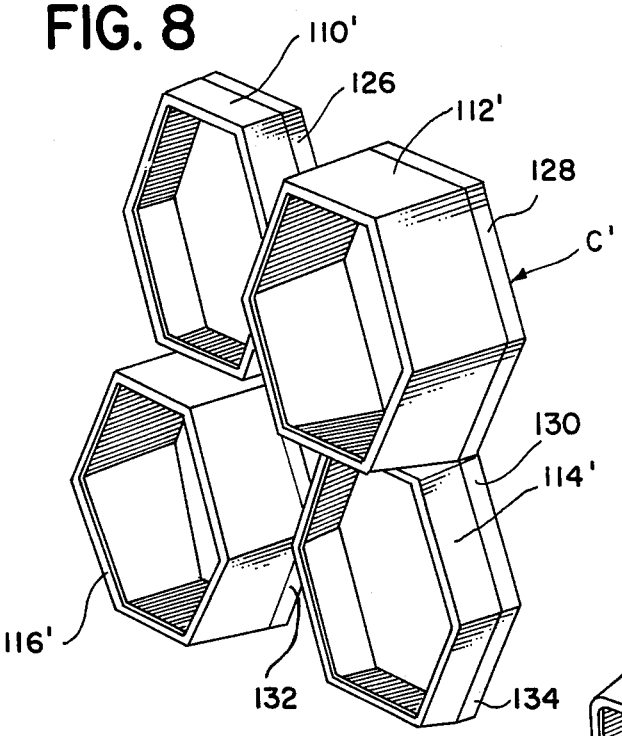
FIG. 10
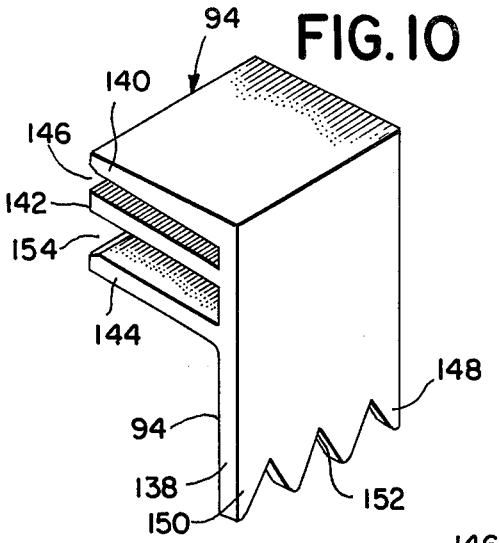
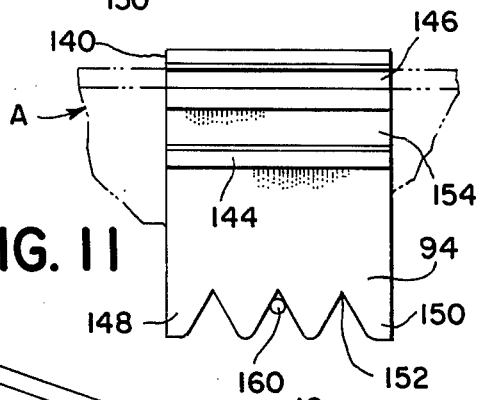
FIG. 11
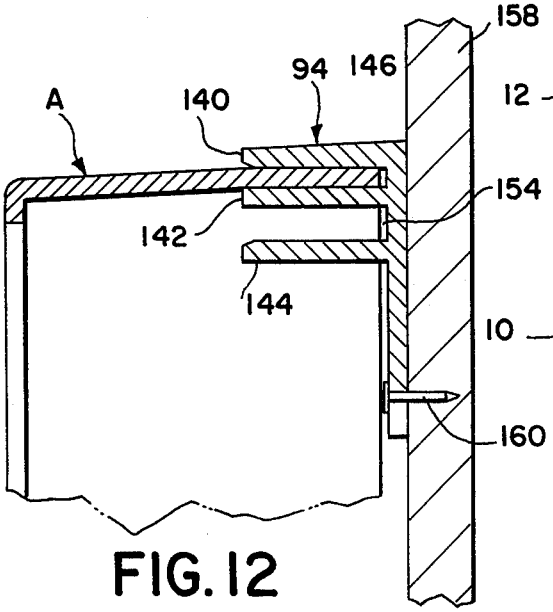
FIG. 12
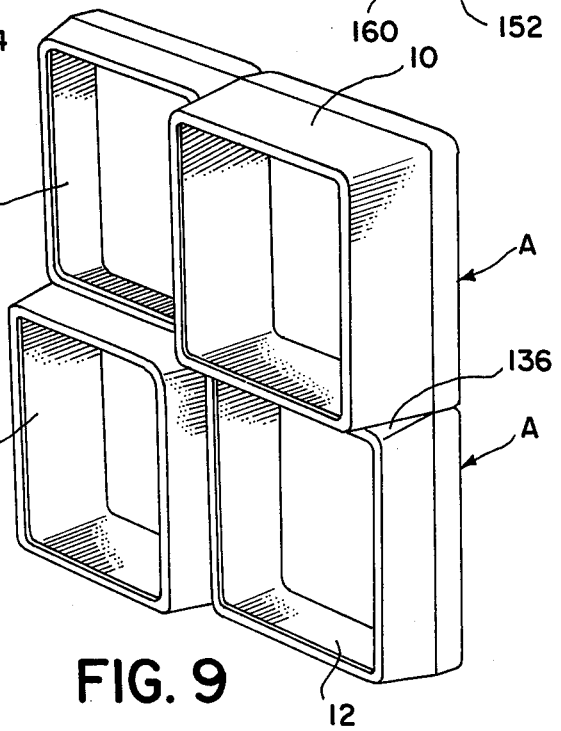
FIG. 9

MODULAR PICTURE HOLDER

BACKGROUND OF THE INVENTION

The present invention relates generally to photograph holders, and more particularly is directed to a modular holder suitable to retain a plurality of pictures, photographs or other objects in multiplanar arrangement.

Prior workers in the art have developed various types of picture frames and display fixtures for holding and displaying objects such as photographs. When it is desirable to display more than one photograph at a time, the prior art picture frames have tended to become relatively complicated in design and expensive in construction. Other prior art frames have been so designed that it is difficult to secure the pictures into the frame and to remove the photograph from the frame. Further, the prior art designs have tended to assume a single appearance or configuration and no one has developed a modular type of photograph holder that can be easily assembled and disassembled with any desired number of modular units to thereby give a varying and pleasing effect in a relatively simple and speedy manner. Typical prior art patents include devices like frames for holding multiples of pictures such as disclosed in U.S. Pat. Nos. 3,813,799, 3,722,122, 3,335,514, D-151,375, 3,659,365, 3,771,246, 3,611,604, 3,471,959, 2,317,708, 2,833,071, 2,788,596, 2,297,574, 501,262, 59,719, 2,218,409, and D-230,808. However it is noteworthy that none of the previous arrangements includes the modular construction of the present invention nor are such designs capable of imparting an enhanced three-dimensional effect to the entire assembly in the manner set forth in the present application.

SUMMARY OF THE INVENTION

The present invention relates generally to the field of photograph or picture holders, and more particularly, is directed to a modular holder which defines a plurality of individual object holding compartments, the said compartments being configured and arranged to retain a plurality of photographs or other objects in multi-planar relationship. The holder can be made of any desired material, conveniently it is made of plastic.

The present invention includes a modular holder having means to define separate object retaining areas. The construction defining each object retaining compartment is rearwardly joined to the next adjacent compartment in a manner to define a planar rear to permit the device to be readily placed against a flat surface, for example, a wall.

The modular holder may be employed to hold or display any type of planar material such as pictures, photographs, art work, decorative pieces and the like. The displayed material may be opaque such as a photograph or may be transparent or translucent such as transparencies or plastic sheets. In the case of transparent or translucent materials, the holder may be advantageously employed in combination with a source of illumination. The construction defining the photograph receiving areas terminates forwardly in a plurality of vertical planes to thereby provide a multi-planar display for the multiple objects held and displayed by the holder. The walls defining each individual photograph holding compartment inclined forwardly form a peripheral area to define intervening canyons, slots, grooves or chasms between adjacent photograph holding compartments. The tapered configuration of the sidewalls creates an uneven, telescopic effect between the adjacent photograph retaining compartments and thereby emphasizes the three-dimensional effect imparted to the photographs when displayed. A peripheral area of each module extends forwardly at ninety degrees from the planar back to provide a peripheral rectangular surface from which the various sidewalls forwardly inclined.

The inclined effect of adjacent picture holding compartments combine wuth the multi-planar front design, the intervening slots and the shadows generated by the configuration of the module to produce a striking, pleasing, visual effect that emphasizes a three-dimensional display. The rectangular peripheral surface permits two or more modules to be rearwardly joined together to create a continuous look. Also, one side of the rectangular peripheral surface may be rested directly upon a horizontal flat surface, such as a desk top, to provide a free standing photograph display device.

Two or more modular units can be joined together by employing suitable clips which connect the units at the rear thereof. It will be noted that any side of a modular unit can be arranged in juxtaposed relationship to any other side of another modular unit to thereby create a relatively infinite number of configurations, using the same basic modular arrangement. Each picture holding compartment terminates forwardly in a peripheral flange or lip which defines the forward limit of travel of an object within the picture containing compartment. The object, such as a photograph, can be readily retained within the space by cutting the photograph slightly larger than the size of the compartment at the front face thereof and then introducing the photograph into the space from the rear. The tapered sides serve to frictionally engage the photograph sides to thereby retain the photograph in association with the holder. If desired, a relatively stiff back up cardboard can be similarly cut and pushed inwardly in conjunction with the photograph to additionally serve to frictionally retain the photograph within the holder.

In a preferred means of construction, there is provided a retaining ridge or ridges which may be in the form of integral projections or pins which are spaced rearwardly from the peripheral flange a distance of slightly greater than the thickness of the photograph. By pushing the photograph forwardly within the enclosed space and over the retaining ridge or ridges, the photograph or other object can be secured between the four peripheral flange and the retaining ridge.

The holder of the present invention in its basic embodiment could be a single object receiving compartment defining an enclosed, object holding space. The object receiving compartment could be defined by four sides which slant forwardly in a truncated pyramid configuration. At least on of the sides is adapted to define a groove between it and a side of another holder. Other embodiments could be modules comprising two, three, four or more joined object receiving compartments.

It is therefore an object of the present invention to provide an improved modular picture holder of the type set forth having an emphasized three dimensional effect.

It is another object of the present invention to provide a novel modular photograph holder including a rear construction which terminates in multi-planar arrangement.

It is another object of the present invention to provide a novel modular photograph holder including a plurality of individual photograph retaining areas, each said compartment terminating rearwardly in a single plane and forwardly in more than one plane, each compartment being forwardly defined by a peripheral flange for photograph retaining purposes.

It is another object of the present invention to provide a novel modular photograph holder incorporating means to display a plurality of photographs in multiplanar arrangement.

It is another object of the present invention to provide a novel modular photograph holder including a plurality of joined photograph receiving areas for retaining photographs therein and means to secure a photograph within each respective photograph receiving compartment.

It is another object of the present invention to provide a novel modular photograph holder including a plurality of interconnected individual photograph retaining boxes, the boxes being rearwardly joined and forwardly not joined to define V or U-shaped slots therebetween to ehance the three-dimensional appearance afforded by the holder.

It is another object of the present invention to provide a novel modular photograph holder including a plurality of photograph retaining boxes, the boxes being rearwardly joined and forwardly not joined, the boxes being formed with inclined sides whereby the cross sectional area at the front of each box is less than the cross sectional area at the rear of each box.

It is another object of the present invention to provide a novel modular photograph holder that is simple in design, inexpensive in manufacture and esthetically pleasing.

Other objects and a fuller understanding of the invention will be had by referring to the following description and claims of a preferred embodiment thereof, taken in conjunction with the accompanying drawings, wherein like reference characters refer to similar parts throughout the several views and in which:

BRIEF DESCRIPTION OF THE DRAWINGS

FIG. 8 is a perspective view of another modified modular photograph holder.

FIG. 9 is a front perspective view showing two modified modular photograph holders of FIG. 1.

FIG. 10 is a perspective view of a clip suitable for use with the modular photograph holders of the invention.

FIG. 11 is a front elevational view thereof showing the clip of FIG. 10 employed as a hanger.

FIG. 12 is a cross sectional view showing the clip of FIG. 10 employed as a hanger.

DESCRIPTION OF THE PREFERRED EMBODIMENT OF THE INVENTION

Figure 1:
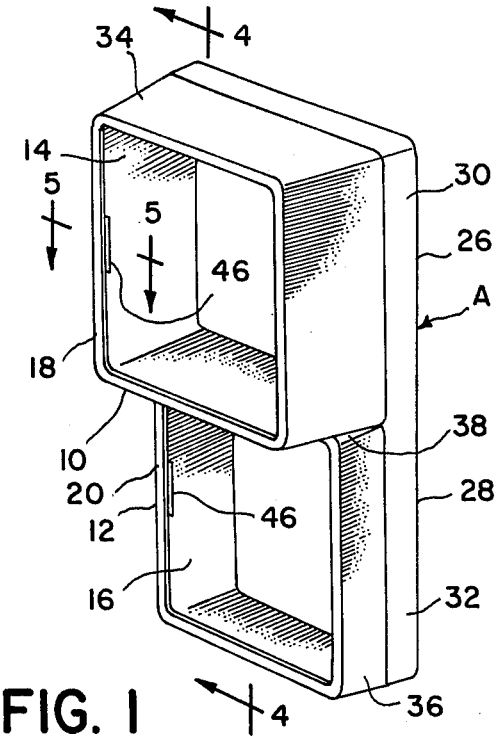
FIG. 1 is a perspective view of a two compartment modular object holder constructed in accordance with the present invention.

Although specific terms are used in the following description for the sake of clarity, these terms are intended to refer only to the particular structure of the invention selected for illustration in the drawings and are not intended to define or limit the scope of the invention.

Referring now to the drawings, FIG. 1 shows a modular picture holder generally designated A comprising two adjacent picture holding compartments 10, 12. The compartments 10, 12 are shown in vertical alignment and define respective interior spaces 14, 16 which receive photographs or other planar materials such as cards, sheets, tapestries, etc. (not shown) therewithin. Each photograph holding compartment 10, 12 terminates forwardly in a peripheral lip 18, 20 for photograph holding purposes. It will be noted that the peripheral lip 18 of the upper photograph holding compartments 10 terminates in a vertical plane 22 which is spaced from a vertical plane 24 defined by the peripheral lip 20 of the lower photograph holding area 12. Each of the photograph holding compartments 10, 12 terminate rearwardly in a peripheral edge 26, 28. The peripheral edges 26, 28 are coplanar and defined a continuous, planar rear terminus of the modular photograph holder A to thereby permit the device to be applied against a flat surface such as a wall (not shown) when it is desired to hang a holder for photograph display purposes. In the embodiment illustrated, the areas 10, 12 are shown in vertical alignment. It is within the scope of this invention to also position the photograph holding compartments 10, 12 out of registry whereby one area may be partly horizontally offset relative to the other.

Figure 4:
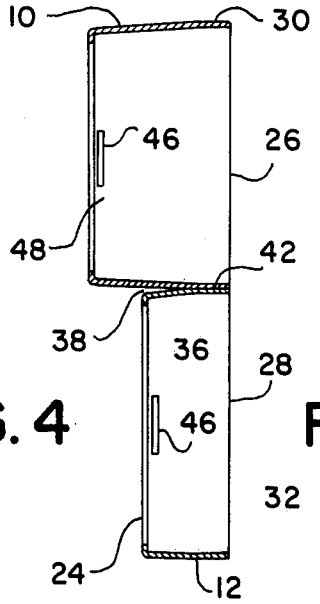
FIG. 4 is a cross sectional view taken along Line 4—4 of FIG. 1, looking in the direction of the arrows.

As best seen in FIGS. 1 and 4, each of the photograph or other object holding compartments 10, 12 is formed with an integral rearwardly positioned, peripheral rectangular section 30, 32 which peripherally defines the rearward extension of each of the photograph holding compartments 10, 12/ The rectangular sections 30, 32 respectively terminate rearwardly at the planar peripheral edges 26, 28. The rectangular sections 30, 32 terminate forwardly in a respective mounting section 34, 36. It will be noted that the rectangular section 30 and the mounting section 34 define the entire upper photograph holding area 10 and the rectangular section 32 and mounting section 36 define the photograph holding compartment 12. Each of the mounting sections 34, 36 are in the configuration of hollow, truncated pyramids which incline generally forwardly from the rearwardly positioned rectangular section 30, 32.

The forwardly inclined sidewalls of adjacent mounting sections 34, 36 define a canyon, slot or chasm 38 between the adjacent area sidewalls 40, 42. This canyon or V-shaped groove 38 separates one picture holding compartment 10 from the other 12 in a manner to enhance the three dimensional effect of the holder. The spacing between the planes 22, 24 of the photograph holding compartments 10, 12 combine with the visual effect of the canyon 38 which is defined between adjacent photograph holding compartments to provide a striking, three dimensional feeling when viewing photographs or other sheet materials (not shown) retained within the respective photograph holding compartments.

Canyon or groove 38 is illustrated generally V-shaped in configuration, but the invention is not limited to a particular configuration. For example, canyon 38 can be formed by a slot having parallel sidewalls, have a rounded bottom, or it can be shaped as a groove, which can be V- or U- or otherwise shaped. Since two adajcent sides of the object holding compartments define the groove, its shape is defined by the configuration of the two sides. While the V- or U-shaped groove gives quite striking depth and three-dimensional effects, other quite remarkable effects are created by other shapes. Different shadow effects are created by wavy, or curved sides or the like, or by dissimilar sides of the same groove; or by dissimilar shaped grooves between different compartment. Since the holders of the invention are conveniently manufactured in plastic, (as by injection molding), a comparatively simple shape, like a V-shape, generally fulfills the requirements adequately to be quite satisfactory.

Figure 5:
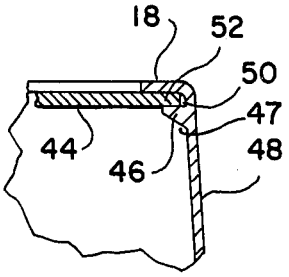
FIG. 5 is a cross sectional view taken along Line 5—5 of FIG. 1 looking in the direction of the arrows.

FIG. 5 shows one method of securing a photograph or other planar sheet 44 within a photograph holding compartment, for example, compartment 10 wherein a pair of horizontally opposed ridges 46 (only one being illustrated) are provided in the compartment sidewall 48 in spaced relationship from the peripheral forward lip 18 of the photograph holding compartment. The ridge 46 may extend peripherally about the entire compartment 10 if so desired. Each ridge is fabricated with a forwardly sloping face 47 to facilitate passing a sheet 44 forwardly to lock the sheet between the ridge and the lip 18. It is often preferred to provide only a single pair of opposed ridges 46 of height less than the entire height of a sidewall 48. Preferably, the ridges 46 extend in length a distance equal to approximately one quarter to one half the height of the sidewall 48. As best seen in FIG. 5, the ridges 46 are rearwardly spaced from the lip 18 a distance slightly greater than the thickness of the photograph 44 to thereby define a retaining area 50 suitable to lock one edge 52 of the photograph 44 therewithin. By providing a pair of cooperating, horizontally (or vertically) opposed ridges, the photograph can be easily and securely locked in position immediately rearwardly adjacent to the peripheral lip 18.

Figure 4A:
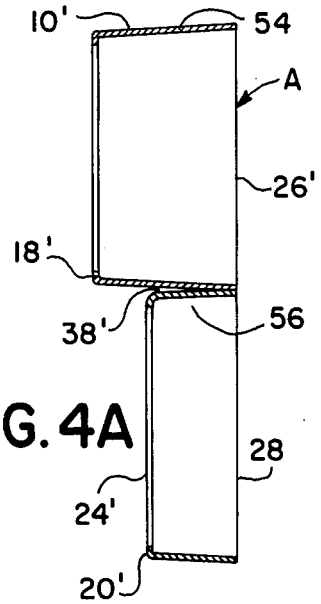
FIG. 4A is a cross sectional view similar to FIG. 4 showing a modified side wall construction.

FIG. 4A, shows a modified modular photograph holder A*:* which is similar to the photograph holder A with the exception that the photograph holding compartments 10*:*, 12*:* are each formed with a plurality of straight, peripheral, enclosing side walls 54, 56. There are no rearwardly positioned rectangular sections as illustrated in FIGS. 1 and 4. Each of the peripheral sidewall constructions 54, 56 is in the form of a hollow truncated pyramid and the sidewalls incline gently forwardly from the co-planar rear edges 26*:*,28*:* to the forward peripheral lips 18*:*,20*:* which are spaced from each other. The adjacent panels of the sidewalls 54, 56 define a canyon or groove 38*:* therebetween to enhance the three-dimensional viewing effect of the device.

It will be noted that the rectangular sections 30, 32 of the device in FIGS. 1 and 4 could permit the modular photograph holder A to be self supporting so that the device can rest vertically upon a horizontal surface such as a table (not shown) without any additional support. The sidewall construction of the modular photograph holder A*:* illustrated in FIG. 4A cannot rest directly upon a horizontal surface and hold the photograph in vertical alignment inasmuch as each panel comprising the sidewall construction 54, 56 of each of the photograph holding compartment 10*:*, 12*:* is inclined. Either of the holders A or A*:* can be hung against a vertical surface such as a wall by applying the rearward peripheral edges 26, 28 and 26*:*, 28*:* (which are respectively coplanar) directly against the wall (not shown).

Still referring to FIG. 4A, an additional modification has been provided wherein the photograph locking ridges 46 have been eliminated. It will be noted that the panels comprising peripheral sidewall constructions 54, 56 taper forwardly inwardly from the rear peripheral edges 26*:*, 28*:* to the forwardly positioned peripheral lips 18*:*, 20*:*. By utilizing this change in cross sectional area from rear to front in each of the photograph holding compartments 10*:*, 12*:*, it is possible to retain a photograph 44 in association with each of the peripheral lips 18*:*, 20*:* by employing frictional forces. In this embodiment, a photograph (not illustrated) should be trimmed to dimensions which conform to and slightly exceed the cross sectional dimensions at the interior side of the peripheral lips 18*:*, 20*:*. Then by introducing the photograph through the rear open areas defined by the respective peripheral edges 26*:*, 28*:* and urging the photograph forwardly, a frictional engagement can be developed between the peripheral edge of the photograph and the interior peripheral edge of the sidewalls 54, 56 immediately rearwardly adjacent the photograph holding lips 18*:*, 20*:*.

Figure 2:
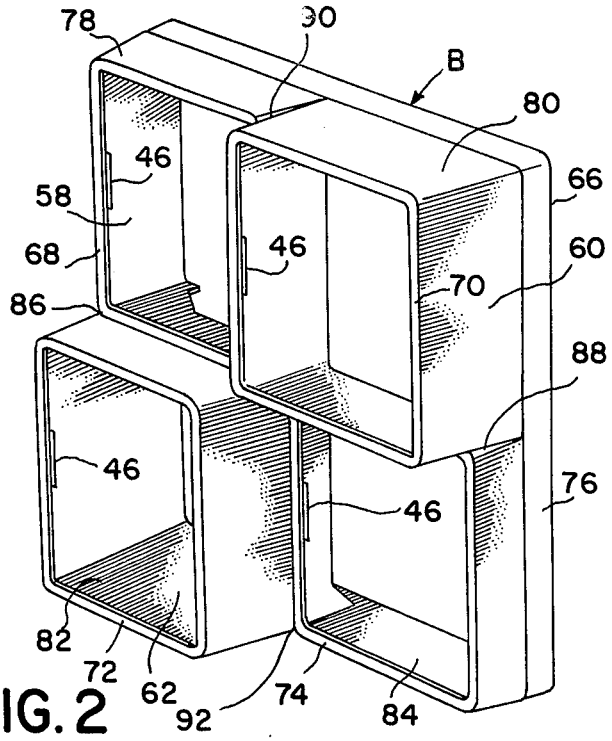
FIG. 2 is a perspective view of a four compartment modular photograph holder constructed in accordance with the present invention.
Figure 3:
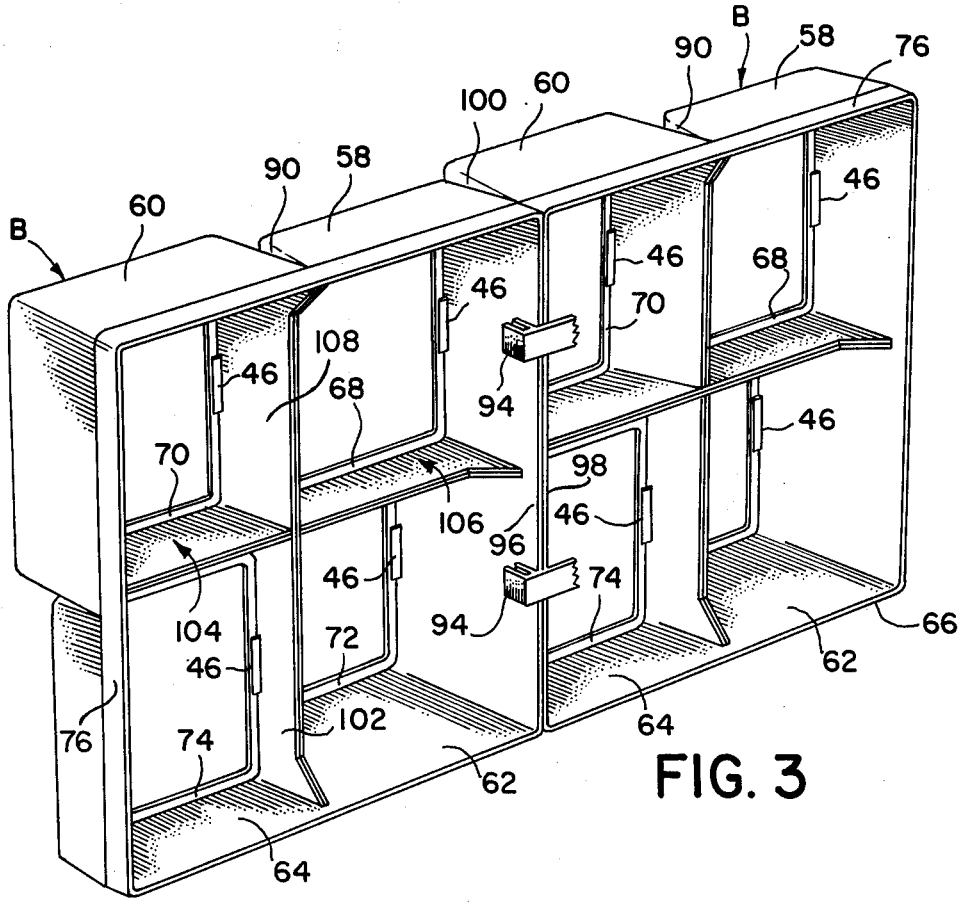
FIG. 3 is a rear perspective view showing two modular photograph holders of FIG. 2 clipped together.

FIGS. 2 and 3 illustrate a modified modular photograph holder B which is molded or otherwise fabricated to include four photograph holding compartments 58, 60, 62, 64. The photograph holding compartments 58, 60, 62, 64 are designed generally similarly to the photograph holding areas 10, 12 and terminate in a planar rear edge 66. The photograph holding extend forwardly from the rear edge 66 and terminate in respective peripheral lips 68, 70, 72, 74 which define the forward extensions of the individual photograph holding compartments and which preferably position in a plurality of vertical planes to thereby impart a three dimensional viewing effect to the entire module B. In the manner hereinbefore described with regard to the embodiment of FIGS. 1 and 4, there is provided at least two opposed sides defining each photograph holding compartment 58, 60, 62, 64 with a photograph retaining ridge 46 to facilitate securing a photograph (not shown) within each of the photograph holding compartments.

A rearwardly positioned, peripheral rectangular section 76 surrounds the modular photograph holder B. The rectangular section 76 could be employed to support the device upon a horizontal surface (not shown) such as a table. Each photograph holding compartment 58, 60, 62, 64 includes a respective forward mounting section 78, 80, 82, 84, which sections extend forwardly from the peripheral rectangular section 76. Each of the photograph mounting sections 78, 80, 82, 84 are formed generally to the configuration of a hollow, truncated pyramid. Each photograph mounting section 78, 80, 82, 84 terminates rearwardly at the rectangular section 76 and forwardly at the respective peripheral lips 68, 70, 72, 74. The inclination of the adjacent sidewall panels defining the forward mounting sections of the photograph holding areas creates V-shaped canyons or grooves between contiguous photographed holding compartments. For example, canyons 86, 88 are defined between the vertically contiguous photograph holding compartments 58, 62 and 60, 64 and canyons 90, 92 are defined between the horizontally contiguous areas 58, 60, and 72, 64. The canyons 86, 88, 90, 92 may be V-shaped, U-shaped, or otherwise in cross section, as discussed above.

As illustrated in FIG. 3 two or more modular photograph holders B can be easily joined by employing one or more clips 94 to rearwardly secure adjacent rear wall portions 96, 98 of the respective peripheral rectangular sections 76 of each of the modular holders B together.

Still referring to FIG. 3, it will be noted that adjacent modular photograph holders B define additional canyons or grooves 100 between adjacent photograph holding compartments, for example compartment 58 and compartment 60 to thus continue the three-dimensional effect as modules are joined together. This construction defining canyons 100 which results as additional modules are placed in adjacent relationship defines a structure that has continuity in appearance so that it will be virtually impossible to tell whether a given design is fabricated of a plurality of modules which are clipped together or whether the design in fact is a single construction specifically fabricated for a given purpose. In a preferred construction, the contiguous sidewalls of adjacent photograph holding compartments 102, 104, 106, 108, terminate forwardly of the planar rear edge 66 to a distance equal to approximately the width of the rectangular section 76. This construction provides additional access to the photograph holding compartments to facilitate placement of the individual photographs within the photograph holding compartments.

Figure 6:
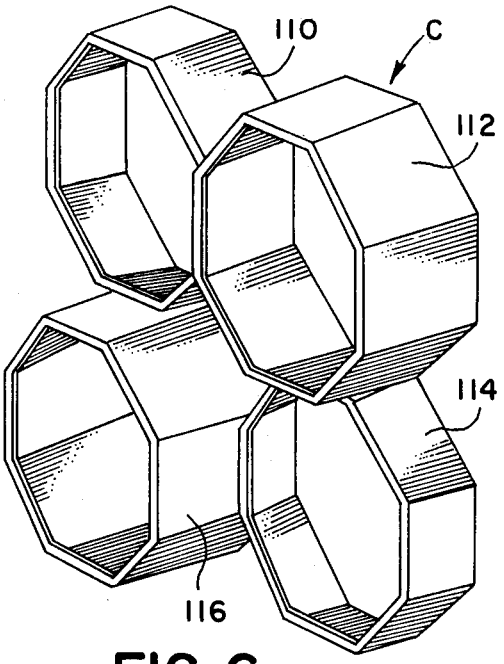
FIG. 6 is a perspective view of a modified type of modular photograph holder.
Figure 7:
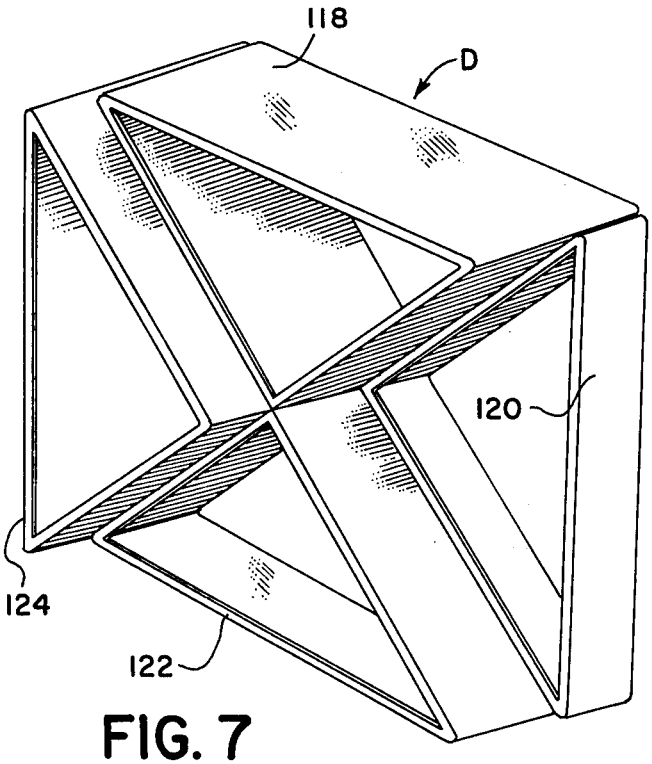
FIG. 7 is a perspective view of another modified modular photograph holder.

FIGS. 6 and 7 show modified modular photograph holders C, D wherein the individual photograph holding compartments are fabricated of shapes other than generally rectangular as in the embodiments of the modular holders A and B. FIG. 6 illustrates the modular photograph holder C as comprising a plurality of adjacent, hexagonal photograph holding compartments 110, 112, 114, 116. In FIG. 7, the modular photograph holder D comprises a plurality of triangularly shaped photograph holding compartments 118, 120, 122, 124. All of the photograph holding compartments in FIGS. 6 and 7 are constructed similarly to the photograph holding compartments of the modular photograph holders A and B in that they terminate rearwardly in a planar rear edge and forwardly in a pluraity of individual peripheral photograph retaining lips which are multi-planar. Also, it is contemplated that all of the photograph holding compartments of the modular holders C and D incline forwardly to define V- or other shaped canyons between adjacent photograph holding compartments. The individual photograph holding compartments can be provided with ridges 46 spaced rearwardly of the peripheral lips for photograph holding purposes in the manner hereinbefore described.

In FIG. 8 I show a modified modular photograph holder C′ which is similar in construction and concept to the modular photograph holder C and includes a plurality of hexagonal shaped photograph holding compartments 110′, 112′, 114′, 116′. The photograph holding compartments are similar to the photograph holding compartments illustrated in FIG. 6, with the exception that each of the compartments includes a rearward section 126, 128, 130, 132 which does not incline forwardly, but rather is formed at a 90° angle with the planar rear edge 134 of the modular holder C′.

Although a few of the various shapes of the picture holding area have been illustrated, others are within the contemplation of the invention. Also different shaped picture holding areas can be affixed together to form various pleasing modular arrangements.

FIG. 9 shows another modular arrangement wherein the modular photograph holders A of FIG. 1 are horizontally disposed and may be clipped together to provide another modular arrangement. In this arrangement, the modules A are arranged so that the smaller photograph holding compartment 12 of one modular holder is positioned adjacent to the larger photograph holding compartment 10 of the other module A. In the manner hereinbefore described, additional canyons 136 will then be defined between adjacent photograph holding compartments of the separate modules to thereby create a similar appearance between all adjacent photograph holding compartments whether such canyons are defined between adjacent photograph holding compartments of a single module or adjacent photograph holding areas of separate modules.

Referring now to FIGS. 10, 11 and 12, there is shown details of a clip 94 which is suitable for use both in joining adjacent modular photograph holders together and in hanging single or multiple, joined modular photograph holders. The clip 94 comprises a body 138 of generally rectangular or other planar configuration which terminates at one end in a plurality of spaced fingers 140, 142, 144. The fingers extend at right angles to the plane of the body 138 and are integral therewith. The fingers 140, 142. 144 are arranged in parallel, spaced relationship with the space between the adjacent fingers 140, 142 equal to or slightly less than the thickness of the periphery of the modular photograph holders A, B, C, D at the respective rear edges thereof.

The clip may be affixed to a modular photograph holder by simply applying the rearward edge of a modular photograph holder to the opening 146 defined between the fingers 140, 142, and then pushing the clip 94 forwardly so that the fingers 142, 144 enter the interior space defined within the modular photograph holders. It is contemplated that the clip will be applied to a top peripheral edge so that the free end 148 of the clip body 138 faces downwardly for module hanging purposes. The free end is formed to a saw-tooth configuration 150 to define a plurality of valleys 152 for modular photograph holder hanging purposes. By affixing a nail 160 to a wall, one of the valleys 152 can be applied over the nail to thereby secure a modular photograph holder A, B, C, or D to a wall in an extremely simple and effective manner.

Figure 13:
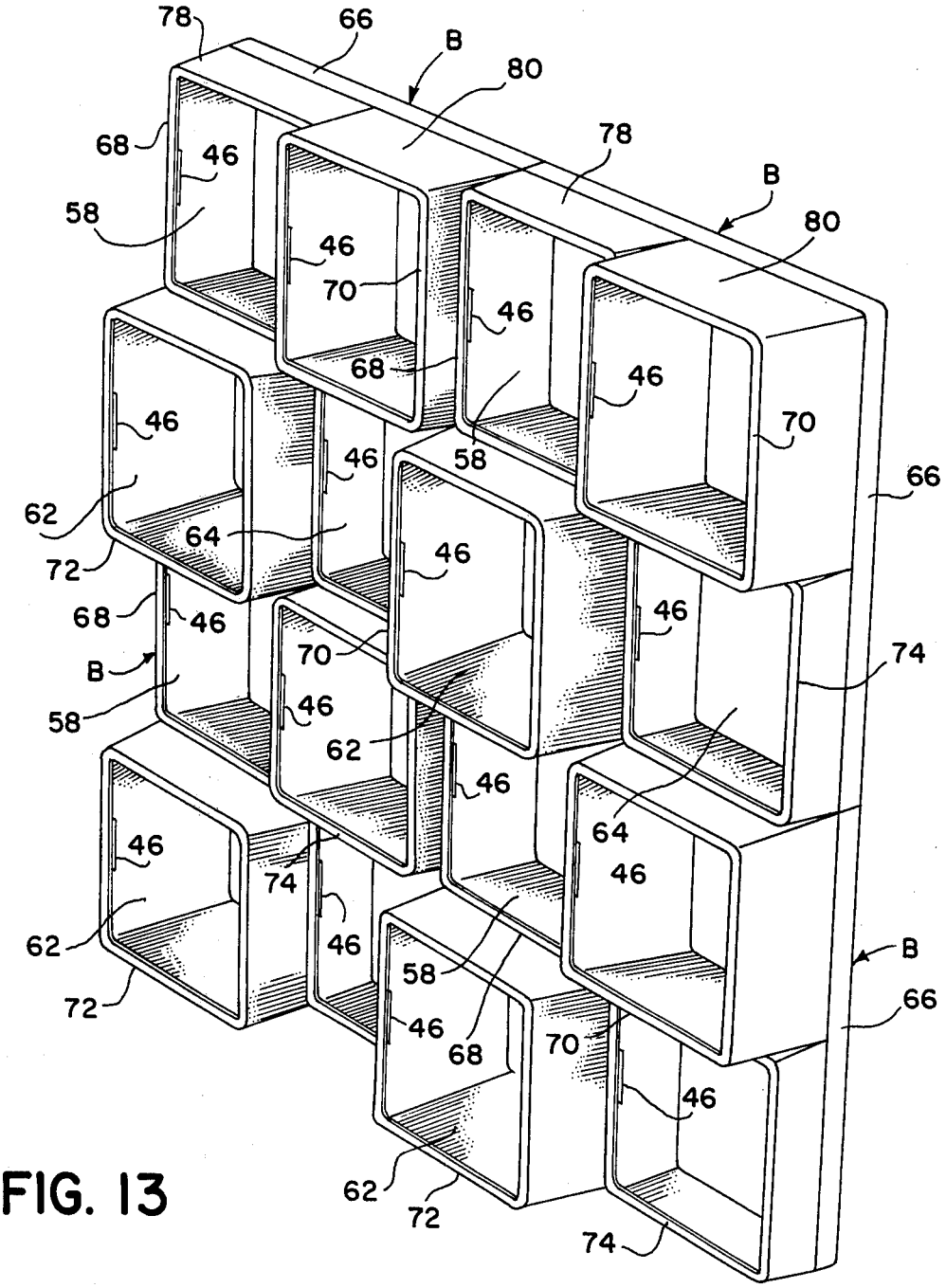
FIG. 13 is a front perspective view showing a plurality of modular photograph holders arranged to form an expanded pattern.

It will be noted that the spacing between the adjacent clip fingers 142, 144 is fabricated to a distance that is twice the distance between the fingers 140, 142 so that the fingers 142, 144 can be employed to secure two modular photograph holders together in adjacent relationship. In order to use the clip 94 for securing adjacent modular holders together, the adjacent portions 96, 98 of separate modular photograph holders are positioned in side by side relationship and the opening 154 between the fingers 142, 144 is urged over the adjacent portions. The fingers 142, 144 are then pushed forwardly inwardly until the rearward edges of the peripheral sidewalls of the modular photograph holders bottom against the clip body 138. In this manner, any number of modular photograph holders can be easily adjoined together to form any desired configuration or pattern. See FIG. 2. Thus, it is seen that one or more clips 94 of a single design can be employed both for joining adjacent modular photograph holders together as in FIG. 3 and FIG. 13 or for hanging purposes as in FIGS. 11 and 12.

It is to be noted that all shadowy effects of the grooves need not be the same; indeed it may be desirable to accentuate to a greater extent the groove between two or more modules than between adjacent object holding compartments, or vice versa. The grooves may be further enhanced by adding any artistic effects as may be desired. These various embodiments emphasize the versatility and pleasing effects of the modular picture holder of the invention.

I claim:

1. In an object holder, the combination of a plurality of four adjacent object receiving compartments in a unitary construction, defined by sides, each compartment having at least one side adjacent to the side of another compartment, each compartment terminating forwardly in a front plane and rearwardly in a rear plane, the two adjacent sides defining a canyon having a closed bottom and an open top therebetween, the two sides being in contact at the bottom and not being in contact at the top, thereby giving an enhanced three dimensional visual effect.

2. The holder of clam 1 wherein each compartment defines two canyons between it and adjacent compartments.

3. The holder of claim 1 wherein at least two compartments terminate forwardly in different forward planes.

4. The holder of claim 1 wherein each of two pairs of compartments terminate forwardly in the different forward planes.

5. The holder of claim 1 wherein at least some of the object receiving compartments terminate forwardly in different forward planes.

6. The holder of claim 1 in which the sides defining a canyon are of unequal height to thereby produce a striking, pleasing, visual effect.

7. The holder of claim 1 wherein adjacent compartments define canyons therebetween and wherein at least some of said canyons are defined by a long side and a short side.

8. The holder of claim 1 wherein at least some compartments are defined by portions of sidewalls which incline inwardly toward the front and wherein the portions of sidewalls connect to wall sections which do not incline and without forming a shoulder.

9. The holder of claim 1 which defines four canyons, a plurality of the canyons having their respective two sides of different lengths.

10. The holder of claim 9 wherein all four canyons have each one having two sides of different lengths.

11. The holder of claim 10 wherein in all four canyons, each one has two sides which join forwardly of the rear plane.

12. The holder of claim 10 wherein in all four canyons, each one has two sides which join at the rear plane.

13. The combination of the holder of claim 1 with another such holder, forming eight object receiving compartments, the two holders being held together by affixing means.

* * * * *